US005366119A

United States Patent [19]

Kline

[11] Patent Number: 5,366,119

[45] Date of Patent: Nov. 22, 1994

[54] DISPENSER BOTTLE WITH INTERNAL PUMP

[76] Inventor: James B. Kline, 902 Lincoln Ave., Grove City, Pa. 16127

[21] Appl. No.: 72,842

[22] Filed: May 26, 1993

[51] Int. Cl.[5] ..... B67D 5/06

[52] U.S. Cl. ..... 222/180; 222/320; 222/340; 222/464

[58] Field of Search ..... 222/180, 320, 340, 416, 222/464

[56] References Cited

U.S. PATENT DOCUMENTS

| | | | |
|---|---|---|---|
| 2,036,698 | 4/1936 | Hill, Jr. | 222/464 |
| 3,990,611 | 11/1976 | Sojka | 222/180 X |
| 4,470,526 | 9/1984 | Cha et al. | 222/464 X |
| 4,759,475 | 7/1988 | Munthe | 222/464 |
| 4,964,543 | 12/1990 | Scheiber | 222/180 |
| 5,186,365 | 2/1993 | Nolte | 222/464 X |

FOREIGN PATENT DOCUMENTS

| | | | |
|---|---|---|---|
| 3829962 | 5/1989 | Germany | 222/464 |

*Primary Examiner*—Andres Kashnikow
*Assistant Examiner*—Joseph A. Kaufman
*Attorney, Agent, or Firm*—Hugh E. Smith

[57] ABSTRACT

A fluid dispenser bottle of the upright variety having a pump dispenser (spout or spray nozzle) at the upper end thereof wherein provided in the interior base of such bottle to direct the contents into a sump at such base, a draw tube engaging within and extending upwardly from the sump to the pump dispenser, and slots in the draw tube to permit the contents of the bottle to flow into the sump.

1 Claim, 3 Drawing Sheets

DISPENSER BOTTLE WITH INTERNAL PUMP

BACKGROUND OF THE INVENTION

1. Field of the Invention

The present invention relates to dispenser bottles and more particularly pertains to such bottles which have a dispenser pump at the upper end thereof.

2. Description of the Prior Art

The use of dispenser pump type bottles is known in the prior art. More specifically, bottles heretofore devised and utilized for the purpose of dispensing fluids therefrom are known to consist basically of familiar, expected and obvious structural configurations, notwithstanding the myriad of designs encompassed by the crowded prior art which have been developed for the fulfillment of countless objectives and requirements. Typical of these are U.S. Pat. Nos. 5,046,666; 5,033,657; 4,979,646; 4,951,840; 4,913,322; and 4,872,596.

Where the fluids to be dispensed are at all viscous such as ketchup, mustard, soaps or the like, the convenient top-mounted dispenser invariably fails to completely empty such contents. Even with less viscous fluids some usually remains.

In this respect, the dispenser bottle according to the present invention substantially departs from the conventional concepts and designs of the prior art, and in so doing provides an apparatus primarily developed for the purpose of completely discharging the entire contents thereof.

Therefore, it can be appreciated that there exists a continuing need for new and improved dispenser bottles which can be easily and completely emptied. In this regard, the present invention substantially fulfills this need.

SUMMARY OF THE INVENTION

In view of the foregoing disadvantages inherent in the known types of dispensers now present in the prior art, the present invention provides an improved dispenser bottle construction wherein the same can be utilized to completely empty the contents therefrom. As such, the general purpose of the present invention, which will be described subsequently in greater detail, is to provide a new and improved dispenser bottle which has all the advantages of the prior art dispensers and none of the disadvantages.

To attain this, the present invention essentially comprises a fluid dispenser bottle of the upright variety having a pump dispenser means (spout or spray nozzle) at the upper end thereof wherein flow directing means are provided in the interior base of such bottle to direct the contents into a sump at such base; a draw tube engaging within and extending upwardly from said sump to the pump dispenser means; and means in said draw tube to permit the contents of such bottle to flow into said sump.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved dispenser bottle which has all the advantages of the prior art dispensers and none of the disadvantages.

It is another object of the present invention to provide a new and improved dispenser bottle which may be easily and efficiently manufactured and marketed.

It is a further object of the present invention to provide a new and improved dispenser bottle which is of a durable and reliable construction.

An even further object of the present invention is to provide a new and improved dispenser bottle which is susceptible of a low cost of manufacture with regard to both materials and labor, and which accordingly is then susceptible of low prices of sale to the consuming public, thereby making such dispenser bottles economically available to the buying public.

Still yet another object of the present invention is to provide a new and improved dispenser bottle which provides in the apparatuses and methods of the prior art some of the advantages thereof, while simultaneously overcoming some of the disadvantages normally associated therewith.

Still another object of the present invention is to provide a new and improved upright dispenser bottle.

Yet another object of the present invention is to provide a new and improved dispenser bottle for viscous fluids.

Even still another object of the present invention is to provide a new and improved dispenser bottle which will discharge its entire contents.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
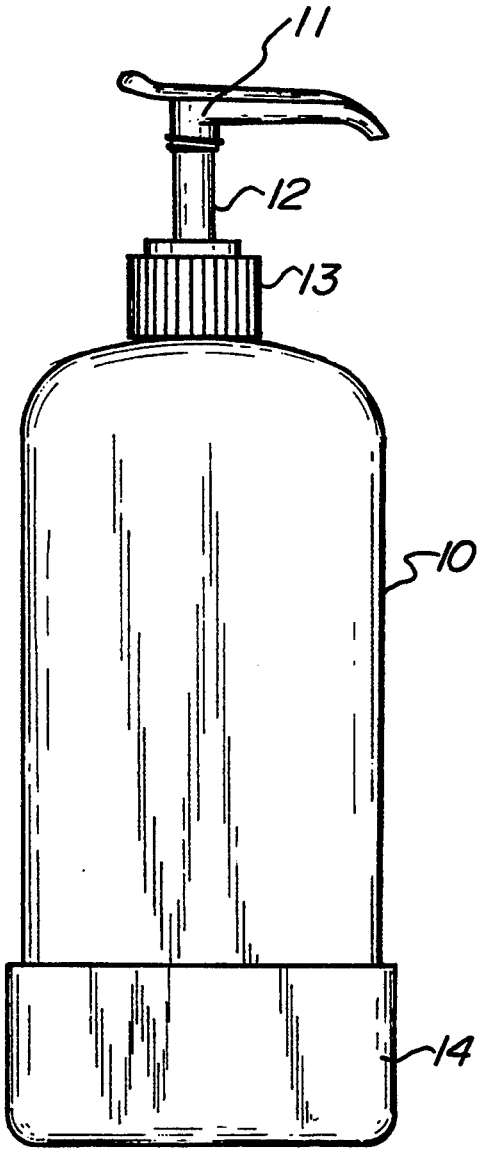
FIG. 1 is a side plan view of the dispenser bottle of the present invention.

With reference now to the drawings, and in particular to FIG. 1 thereof, a new and improved dispenser bottle embodying the principles and concepts of the present invention and generally designated by the reference numeral 10 will be described.

Figure 2:
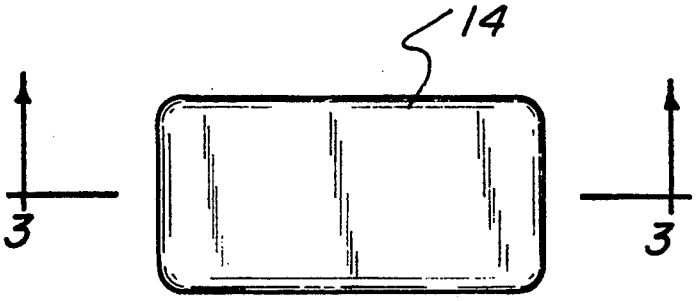
FIG. 2 is a bottom plan view of the dispenser bottle of FIG. 1.

More specifically, it will be noted that the dispenser bottle 10 is of the upright type having a conventional finger operated pump means 11 at the upper portion thereof. The draw tube 12 for extracting the contents of bottle 10 extends down into bottle 10 through a leak-proof closure cap 13. The base 14 of bottle 10 is flat to permit the bottle to stand upright. Base 14 is also shown in FIG. 2 and may be shaped essentially rectangularly as shown or may have a round, square or other configuration as desired.

Figure 3:
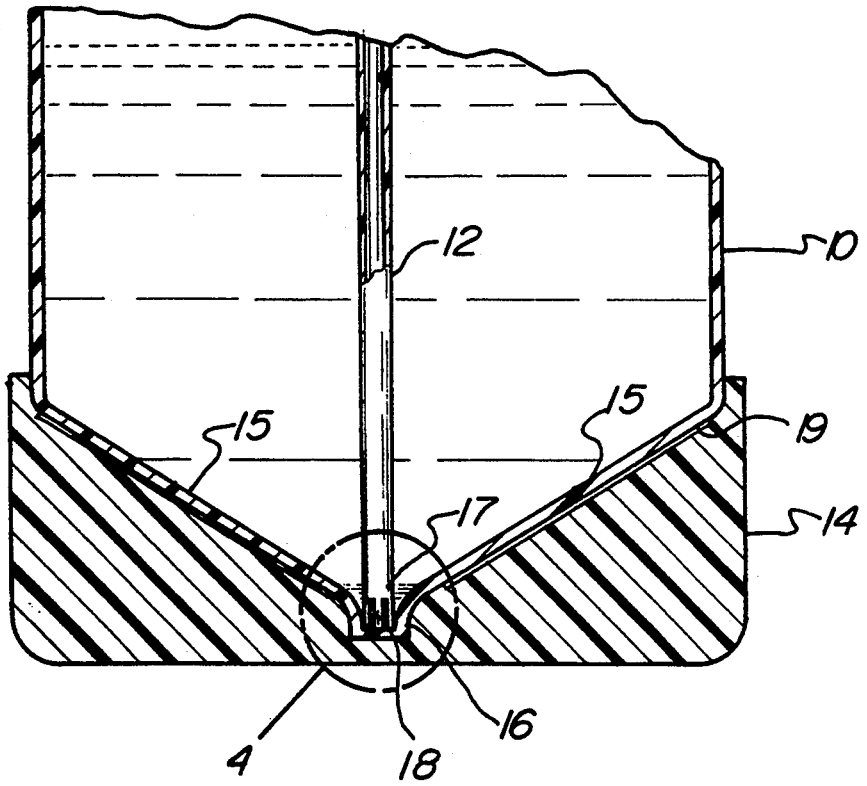
FIG. 3 is a sectional view on line 3—3 of FIG. 2.
Figure 4:
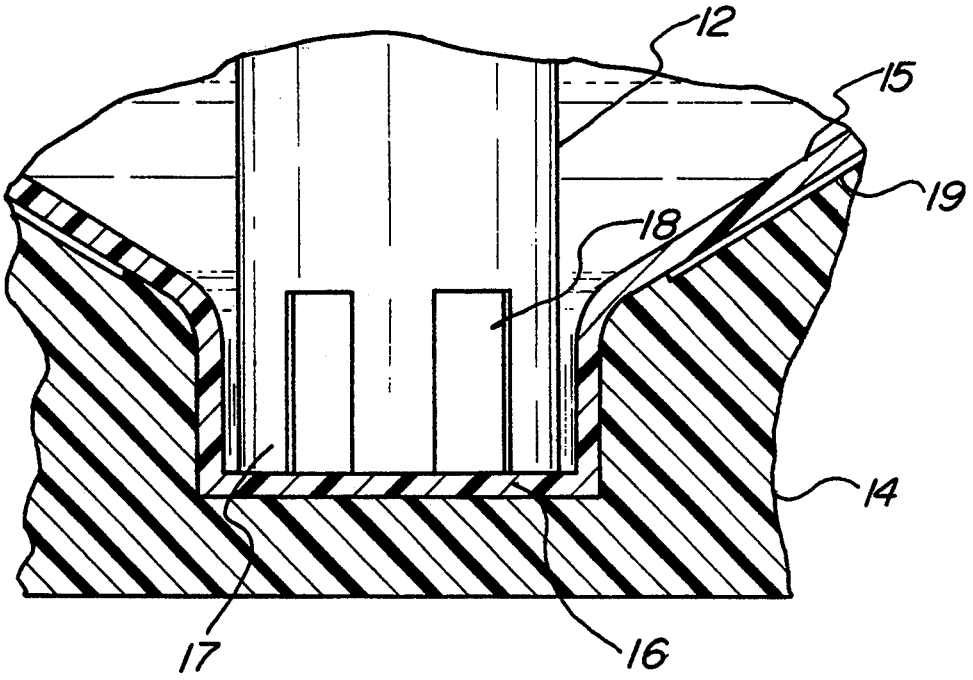
FIG. 4 is an enlarged view of a portion of the drawing of FIG. 3.

FIGS. 3 and 4 show internal details of the present invention. The internal base of the fluid containing receptacle on bottle 10 slopes inwardly as at 15 to terminate in a recessed sump 16 into which extends the bottom end 17 of draw tube 12. Sump 16 is preferably circular but in any event the shape of the bottom end 17 of the draw tube 12 is the same as the shape of such sump 16 so as to permit such bottom end 17 to snugly fit into sump 16. As more clearly shown in FIG. 4, the bottom end 17 of draw tube 12 has a plurality of vertically extending slots 18 therein spaced around such bottom end 17. These slots 18 allow the fluid contents of bottle 10 to drain down the sloped internal base 15 of such bottle and into sump 16 from whence they are sucked up draw tube 12 and discharged from bottle 10 by action of the finger operated pump means 11.

As shown in these FIGURES, the sloped internal base of bottle 10 is inserted into the external flat base of bottle 10 and secured therein by an adhesive layer 19. Obviously, if formed of molded plastic, the bottle 10 and base 14 may be formed integrally thus eliminating the need for adhesive layer 19.

Figure 5:
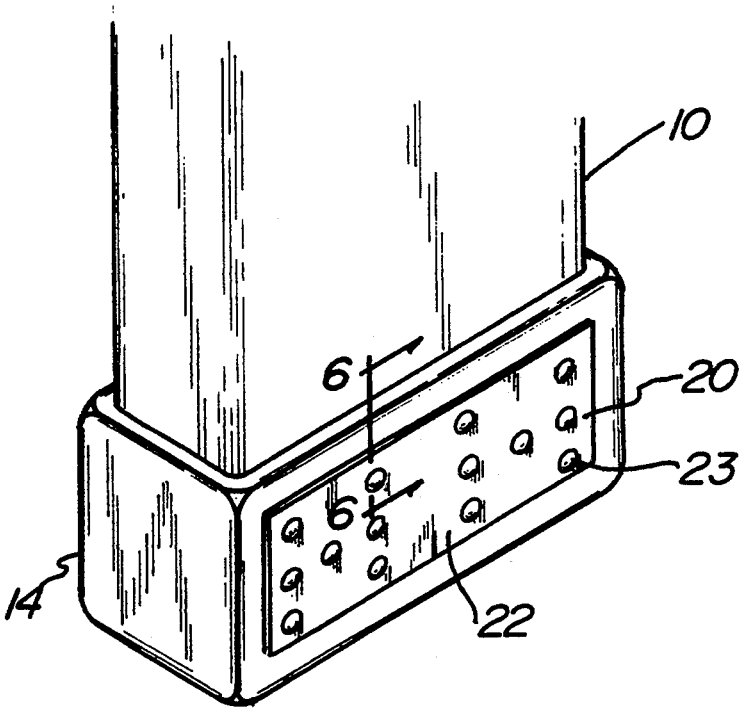
FIG. 5 is a perspective view of the dispenser bottle of the present invention illustrating a means for wall-mounting the same.
Figure 6:
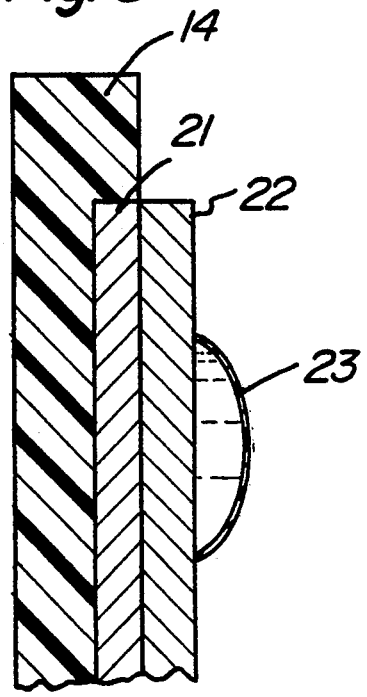
FIG. 6 is a sectional view on line 6—6 of FIG. 5.

Should it be desired to wall-mount dispenser bottler 10, FIGS. 5 and 6 illustrate a convenient means for doing so. Dispenser bottle 10 may be produced and sold with the mounting means 20 affixed to the side of base 14. Such mounting means 20 comprises a pair of magnetic plates 21 and 22 as shown in FIG. 6 wherein one magnetic plate 21 is affixed to or inset in base 14 of bottle 10 and the other magnetic plate 22 is removably in contact with said first magnetic plate 21, and has on its exterior surface, wall engaging and securing means here shown as a plurality of frangible adhesive-containing capsules 23. Upon being applied under pressure to a wall surface, such capsules 23 will rupture and release adhesive which will secure magnetic plate 22 to such wall surface.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A dispenser bottle comprising:

a bottle having a flat exterior base, a sidewall extending around said exterior base and projecting upwardly to terminate in a neck, and a sloped internal base which tapers from said sidewall at a first height from an edge of said internal base to said flat exterior base, to a second height from a center of said internal base to said flat exterior base, with said first height being greater than said second height, said internal base having an integrally formed sump in said center thereof, with said sump having a bottom and a top;

a pump removably mounted to said neck, said pump having a draw tube extending into said sump, said draw tube having a plurality of radially spaced slots with said slots extending from said bottom of said sump to said top of said sump such that fluid present within said sump will be drawn into said slots by said pump;

and, mounting means for securing said bottle to a vertical surface, said mounting means comprising a first magnetic plate fixedly secured to said exterior base, a second magnetic plate having opposed first and second faces, with said first race being magnetically coupled to said first magnetic plate, and a plurality of frangible, adhesive-containing capsules coupled to said second face of said second magnetic plate, whereby said capsules will rupture under pressure when said second face of said second magnetic plate is pressed against said vertical surface, thereby releasing adhesive contained therein and adhesively bonding said second face of said second magnetic plate to said vertical surface.

* * * * *